US006173816B1

(12) United States Patent
Barker et al.

(10) Patent No.: US 6,173,816 B1
(45) Date of Patent: Jan. 16, 2001

(54) HALLWAY-ENTERED DESTINATION INFORMATION IN ELEVATOR DISPATCHING

(75) Inventors: Frederick H. Barker, Bristol; Bruce A. Powell, Canton; Paul A. Simcik, Bristol, all of CT (US)

(73) Assignee: Otis Elevator Company, Farmington, CT (US)

( * ) Notice: Under 35 U.S.C. 154(b), the term of this patent shall be extended for 0 days.

(21) Appl. No.: 09/317,335

(22) Filed: May 24, 1999

Related U.S. Application Data

(63) Continuation-in-part of application No. 08/999,157, filed on Dec. 30, 1997.

(51) Int. Cl.[7] ..... B66B 1/18

(52) U.S. Cl. ..... 187/382; 187/392; 187/387

(58) Field of Search ..... 187/380, 382, 187/383, 385, 387, 389, 392

(56) References Cited

U.S. PATENT DOCUMENTS

| | | | | |
|---|---|---|---|---|
| 4,718,520 | | 1/1988 | Schroder . | |
| 5,092,431 | | 3/1992 | Schroder . | |
| 5,146,053 | | 9/1992 | Powell et al. . | |
| 5,239,142 | | 8/1993 | Ekholm et al. . | |
| 5,305,198 | | 4/1994 | Schroder et al. . | |
| 5,338,904 | | 8/1994 | Powell et al. . | |
| 5,388,668 | | 2/1995 | Powell et al. . | |
| 5,412,163 | | 5/1995 | Tsuji . | |
| 5,427,206 | * | 6/1995 | Powell et al. | 187/387 |
| 5,511,634 | * | 4/1996 | Bahjat et al. | 187/383 |
| 5,612,519 | * | 3/1997 | Chenais | 187/382 |
| 5,616,896 | * | 4/1997 | Kontturi et al. | 187/384 |
| 5,672,853 | | 9/1997 | Whitehall et al. . | |
| 5,936,212 | * | 8/1999 | Whitchall et al. | 187/382 |
| 5,955,708 | * | 9/1999 | Amano et al. | 187/247 |

* cited by examiner

*Primary Examiner*—Jonathan Salata

(57) ABSTRACT

The estimation of the amount of time required by a given elevator to reach a given hall call, known as remaining response time (RRT), can be improved by using not only the present car position, its direction, and the number of intervening stops for already boarded passengers, but also the destination of each waiting passenger. An elevator controller is shown with an algorithm for estimating RRT using such detailed destination information.

4 Claims, 5 Drawing Sheets

HALLWAY-ENTERED DESTINATION INFORMATION IN ELEVATOR DISPATCHING

This is a Continuation-In-Part application of the pending patent application Ser. No. 08/999,157, filed Dec. 30, 1997.

BACKGROUND OF THE INVENTION

1. Technical Field of the Invention

The invention relates to elevator dispatching and, more particularly, to improvements in estimating remaining response time (RRT) to answer a hall call.

2. Discussion of Related Art

Remaining response time (RRT) is the amount of time that a given elevator will require to reach a given hall call floor. For example, a car in the down direction and parked at floor 9 might require 6.0 seconds to respond to a newly registered down hall call on floor 7; in that case it is said that the RRT equals 6.0 seconds. The RRT for another car presently on floor 16 would be much longer. Another important illustration of RRT is the case where a car is in the process of responding to a hall call that has already been waiting for some time. Here, the RRT is the time from now until the car arrives at the hall call floor. The RRT is a key concept in dispatching decisions.

Co-owned U.S. patents pertaining to RRT include, among others, U.S. Pat. Nos. 5,146,053; 5,388,668; 5,427,206; and 5,672,853. Clearly, accuracy of an estimation procedure for RRT is critical, especially as it is applied to dispatchers with ECA (Early Car Announcement: See U.S. Pat. No. 5,338,904). If the destination of each waiting passenger were known, a more accurate prediction of RRT would be possible.

SUMMARY OF THE INVENTION

An object of the present invention is to provide a method and means for estimating RRT where the destination of waiting passengers is factored into the procedure.

According to a first aspect of the present invention, a method for estimating a remaining response time (RRT) for an elevator car from among a plurality of candidate cars to serve an unassigned hall call registered by an intending passenger, comprises the steps of:

- obtaining state information for said car relating to location, motion and direction;
- obtaining all registered car calls assigned to said car for serving already boarded passengers;
- obtaining all registered hall calls already assigned to said car for serving preboarded passengers;
- obtaining destination information of said preboarded passengers and of said intending passenger; and
- computing said RRT based on said state information, said registered car calls, said registered hall calls, and said destination information.

According to a second aspect of the present invention, an apparatus for estimating a remaining response time (RRT) for an elevator car from among a plurality of candidate cars to serve an unassigned hall call registered by an intending passenger, comprises:

- means for obtaining state information for said car relating to location, motion and direction;
- means for obtaining all registered car calls assigned to said car for serving already boarded passengers;
- means for obtaining all registered hall calls already assigned to said car for serving preboarded passengers;

- means for obtaining destination information of said preboarded passengers and of said intending passenger; and
- means for computing said RRT based on said state information, said registered car calls, said registered hall calls, and said destination information, wherein said RRT is computed in accordance with the following equation:

$$RRT=Nf*Tf+Ns*Ts+(Ns+1)*Td,$$

with

- Nf being the number of floors between said car and the unassigned hall call;
- Ns being the number of stops between said car and the unassigned hall call, a stop for each registered car call or each registered hall call;
- Tf being the time for said car to pass each of said floors;
- Ts being the time spent at each of said stops; and
- Td being the delay time for starting car per stop.

In further accord with both aspects of the present invention, the destination information of said intending passenger includes a time lag corresponding to said intending passenger traversing a distance beginning at a time of registering said unassigned hall call to a time of meeting said elevator car.

These and other objects, features and advantages of the present invention will become more apparent in light of the following detailed description of a best mode embodiment thereof, as illustrated in the accompanying drawing.

DETAILED DESCRIPTION OF PREFERRED EMBODIMENTS

Figure 1:
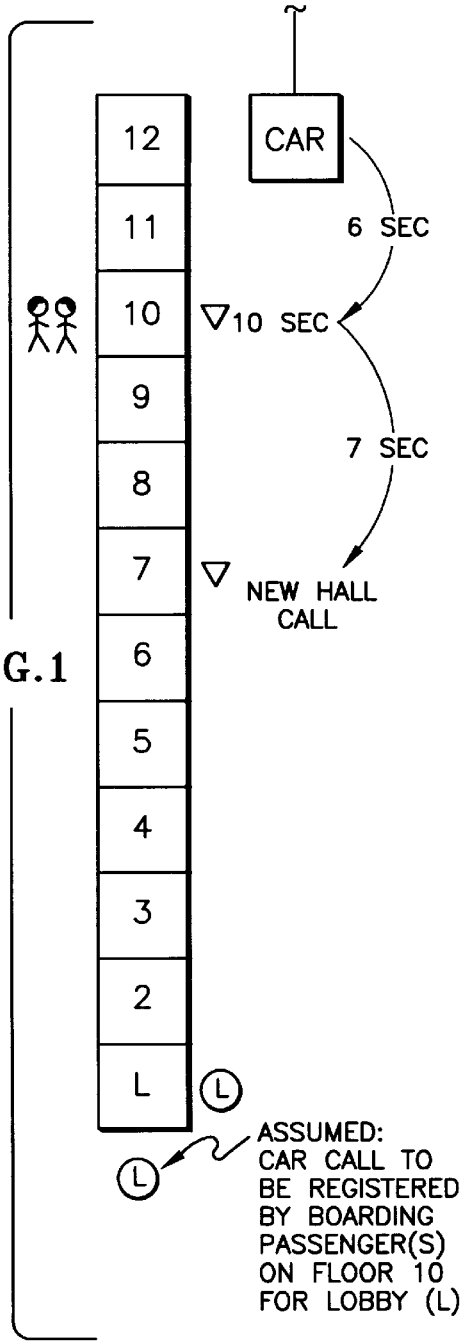
FIG. 1 shows passengers in a building at floor 10 intending to travel to the lobby and waiting to be served by an elevator.

FIG. 1 illustrates a dispatching scenario in which a car on floor twelve is proceeding toward an assigned down hall call on floor ten when a new down hall call is registered on floor seven. The dispatching decision regarding whether or not to assign this car to the new hall call is based on an estimate of response time to reach floor seven. Under a simple but useful estimation procedure used to calculate response time, travel time for an n-floor run is approximated by the formula $$travel_time=5.0+(n-1),$$

which allows for five seconds for the first floor and one second for each subsequent floor. Also, time spent stopped at a floor (for a hall call or car call) is simply assumed to be ten seconds. For FIG. 1, the time required for the car to reach floor seven is estimated to be 23 seconds, which is the sum of three time segments:

6 seconds (travel from 12 to 10)+10 seconds (stop at floor 10 for hall call)+7 seconds (travel from 10 to 7).

In this example, the implicit assumption is made that the passengers boarding the car on floor 10 would be going to the lobby floor. This is a safe assumption in a multi-tenant building. It should be realized, however, that there are many other ways of estimating RRT. See, e.g., U.S. Pat. No. 5,146,053, particularly at col. 6, lines 27–44 and examples given through col. 7, line 55, all of which is hereby incorporated by reference.

Figure 2:
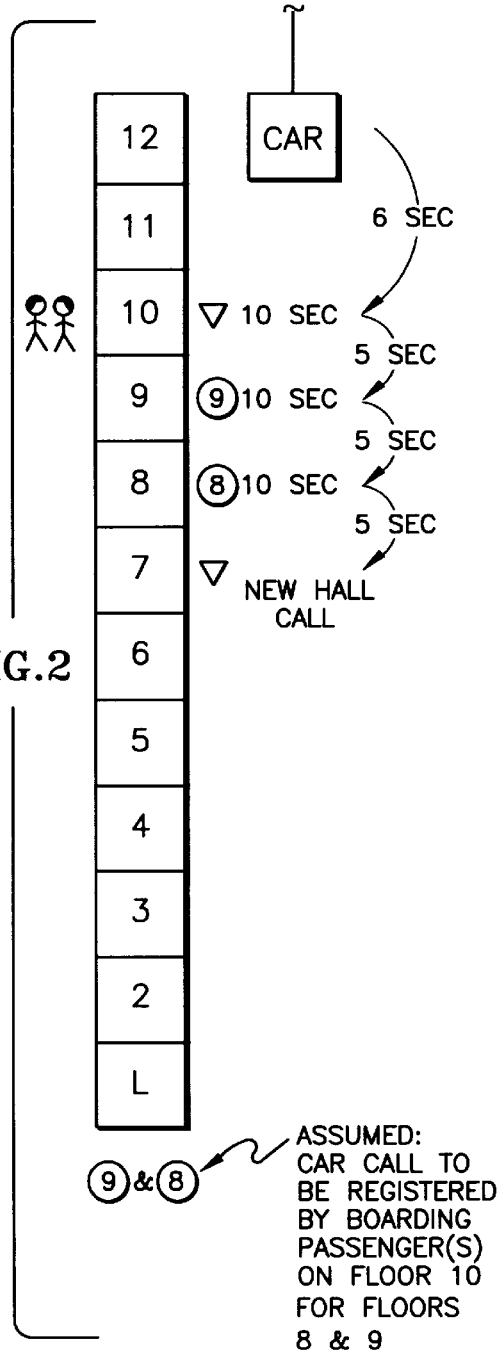
FIG. 2 shows a similar scenario as FIG. 1 with passengers in a building at floor 10 but in this case intending to travel to floors 8 and 9.

With reference to the same example, if on the other hand it were known that the people waiting for the car on floor ten were going to both floors nine and eight then, according to the present invention, the estimated response time to reach floor seven would be 51 seconds, as shown in FIG. 2. The teaching hereof is therefore clear: under the first case (all down-boarding passengers go to lobby), the car would make a good assignment for the new hall call. Under the second case, the car represents a poor assignment, and another car (not shown) would be preferable.

Figure 3:
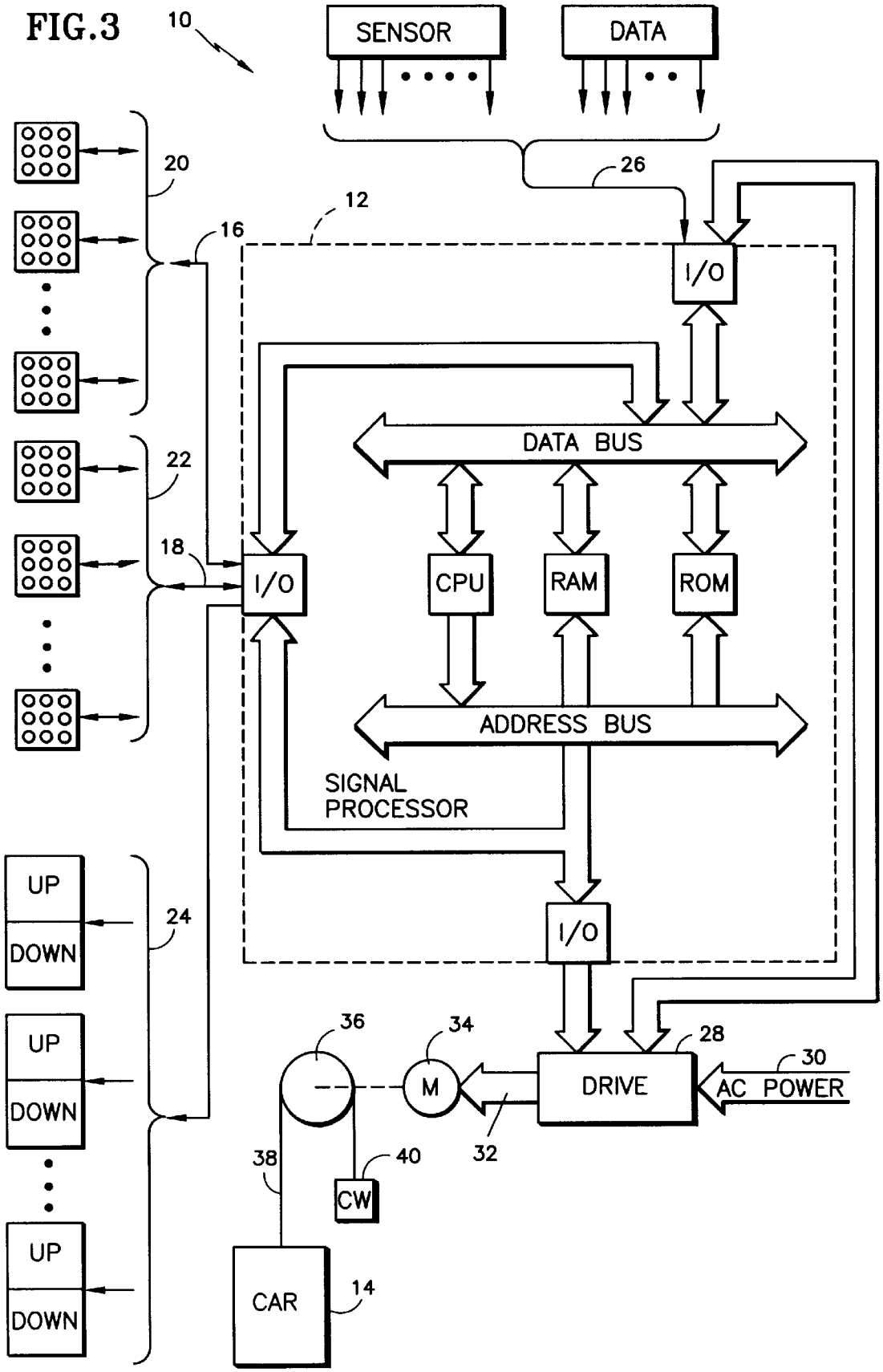
FIG. 3 shows an elevator system according to the invention with a signal processor and various input/output (I/O) devices, including hall call input means with which the intending passenger can input the desired destination floor, for controlling a plurality of elevator cars only one of which is illustrated.

FIG. 3 shows an elevator system 10 including a signal processor 12 which may be an elevator controller for dispatching a plurality of elevator cars, one car 14 of which is shown in a building according to input signals 16, 18 supplied by car call buttons 20 within elevator cars and hall call buttons 22 installed permanently in the various halls at corresponding floors of the building. The signal processor is shown in a conventional way which need not be described in detail. As can be seen in FIG. 3, at least in the case of the hall call buttons 22, each of these include means for indicating which floor the passenger desires to travel to, e.g., by multiple buttons. Although they are only shown with nine buttons, it should be realized that there would be eleven or twelve such buttons for the example of FIGS. 1 & 2. These may be similar to the car call buttons 20, as shown, or may be different in design and even concept. In other words, instead of the commonly used simple up and down push-buttons at each floor, an input device of some kind is used at each floor with which an intending passenger can input the identity of the floor to which he wishes to travel. The input device can be simple in that it can only be used by the first-to-arrive intending passenger or it can be designed in a more complex manner, to allow various passengers to identify various floors to which they want to travel.

Also shown in FIG. 3 are hall lanterns 24 for announcing which car is to serve the passengers. The controller 12 is of course responsive to a variety of sensed and data signals 26 for carrying out its dispatching function such as obtaining state information from these signals for the various cars relating to their locations, motion and direction, as well as any other functions required of it. For example, the controller 12 may also supply output signals to a drive 28 that receives AC utility or auxiliary power 30 for providing power 32 for driving a motor 34 connected to a sheave 36 with a rope 38 connected at one end to said car 14 and at another end to a counterweight 40. Other drive configurations are also usable with the invention and the controller can control more than one car.

Figure 4:
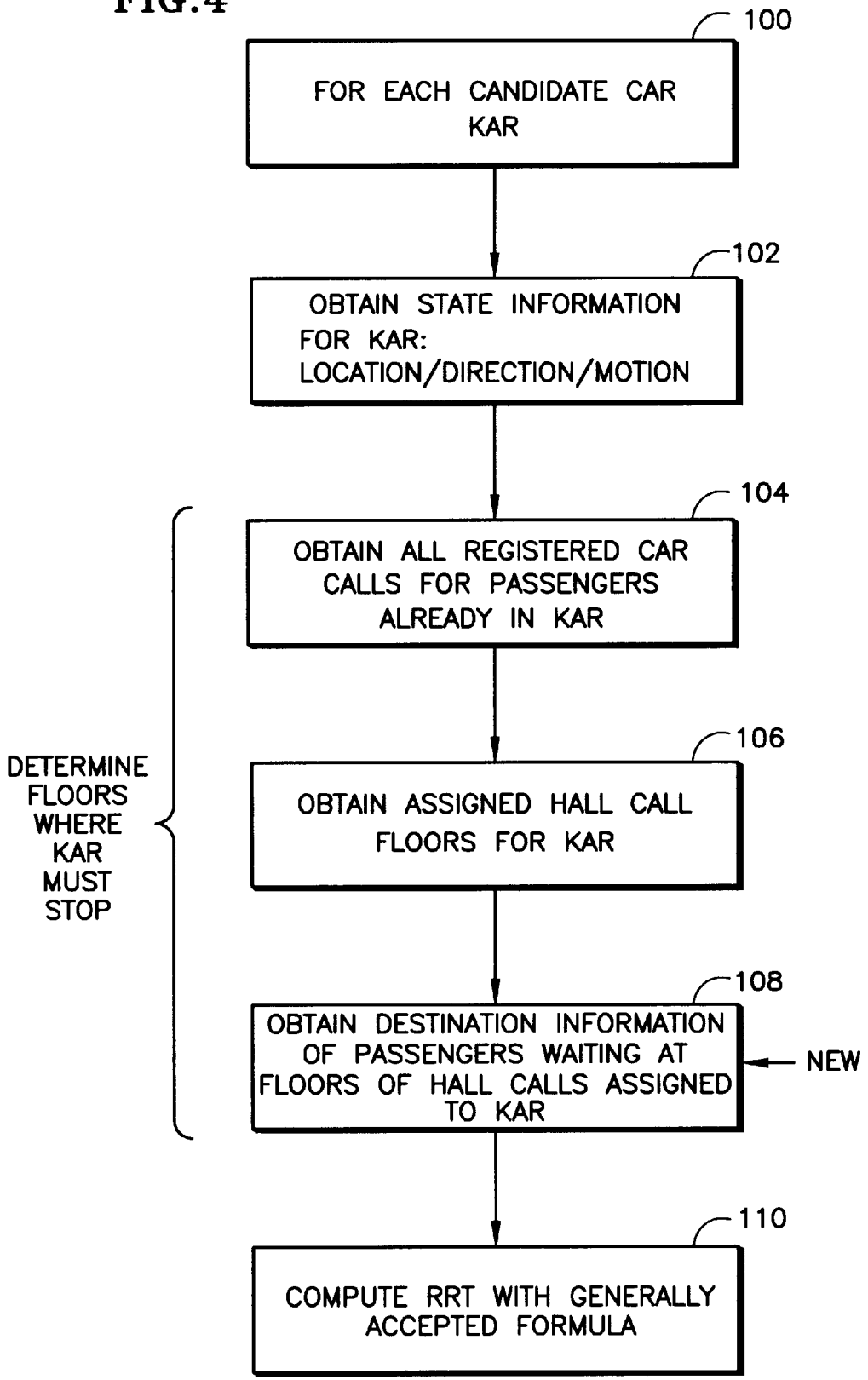
FIG. 4 shows a flowchart that illustrates a new method, according to the invention, for determining RRT using the hall call input means and signal processor of FIG. 3.

FIG. 4 shows a flow chart illustrating the method of the invention in which the destination floors of the waiting passengers is used in the estimation of RRT. In a first step 100, for each candidate car (kar), state information is obtained as indicated in a step 102. These may include location, direction, motion, etc. In a step 106, assigned hall call floors are obtained for each candidate car. According to the present invention, in a new step 108, destination information concerning passengers waiting at floors of hall calls assigned to each candidate car is obtained. Now, having determined the identities of all of the floors where each of the candidate cars must stop, the controller is then in a position to compute, as indicated in a step 110, the RRT for each candidate car, taking into account the floor stop information as entered by means of the hall call buttons 22. This computation would be carried out as illustrated in FIG. 2.

Referring back to FIG. 3, the unstated presumption was that the waiting passenger in the hall entered his destination floor at a device located where the standard up/down call panel is usually located. This is usually situated between elevators in a group of three or more cars.

In such a situation, it is clear that the passenger will be ready to board once the responding car arrives at the hall call floor, especially when an early car announcement signal has been provided.

According further to the teachings hereof, it is also feasible to have the passenger enter the destination information on a wall-mounted panel located some significant distance away from the waiting area. This can be a standard up/down button set or a multibutton set such as shown in FIG. 3. It should be understood however that this improvement is not limited to inputs from wall-mounted devices. The destination floor inputs could also come from a wireless RF device, for instance. A distance of 40–60 feet is not inconceivable, and the passenger would need some 10–15 seconds to reach the doorway of the closest elevator. Under this situation, a car that reached the floor in, say seven seconds would do one of two things: (a) wait for the passenger to finish walking to the doorway, or (b) recognize that no one is there to board and close the doors and leave. Either situation is undesirable. For case (a), passengers already on board will get impatient as will those waiting at other floors, since the car will be delayed. For case (b), the stop is wasted, any on-board passengers will become angry, and people at other floors will have been made to wait longer. In addition, another car must be dispatched.

In the above situations of a remotely located panel it is desirable to be sure that the passenger will be in the waiting area for the elevators when a responding car arrives. To assure this, according to teachings hereof, the advance destination information should not be used by the control system until a reasonable time has elapsed. This lag time . . . for example 10 seconds . . . allows the passenger who entered the information enough time to walk to the waiting area.

The signal processor of FIG. 3 includes a memory device which can be used for temporarily storing the destination information. In addition, a software timer can be included in the permanent memory of the processor. The length of the lag time is determined with reference to the particular device used for inputting the destination floor and its location in relation to the car door openings in the hall.

Figure 5:
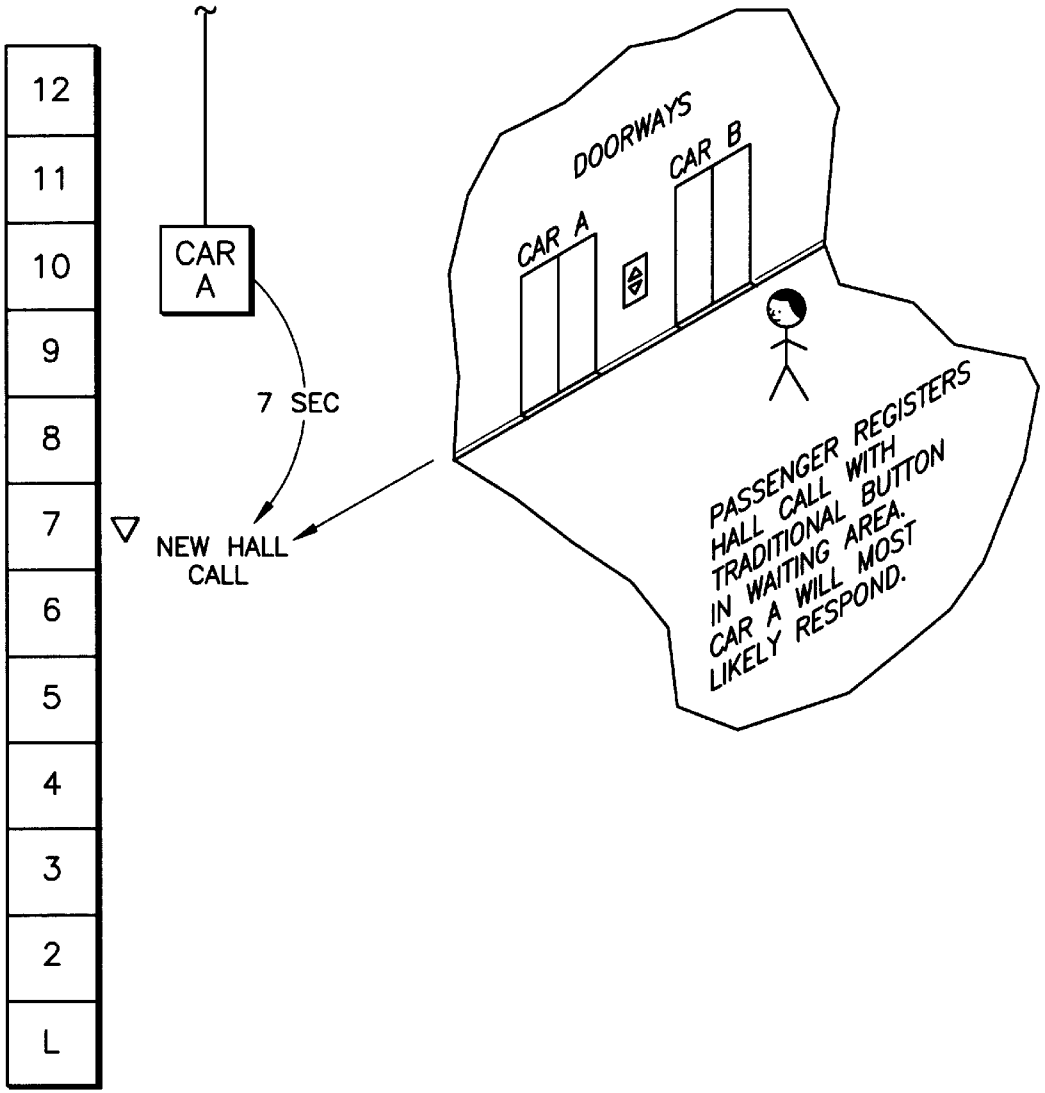
FIG. 5 shows an intending passenger registering a hall call with a traditional up/down button set in the hall area.
Figure 6:
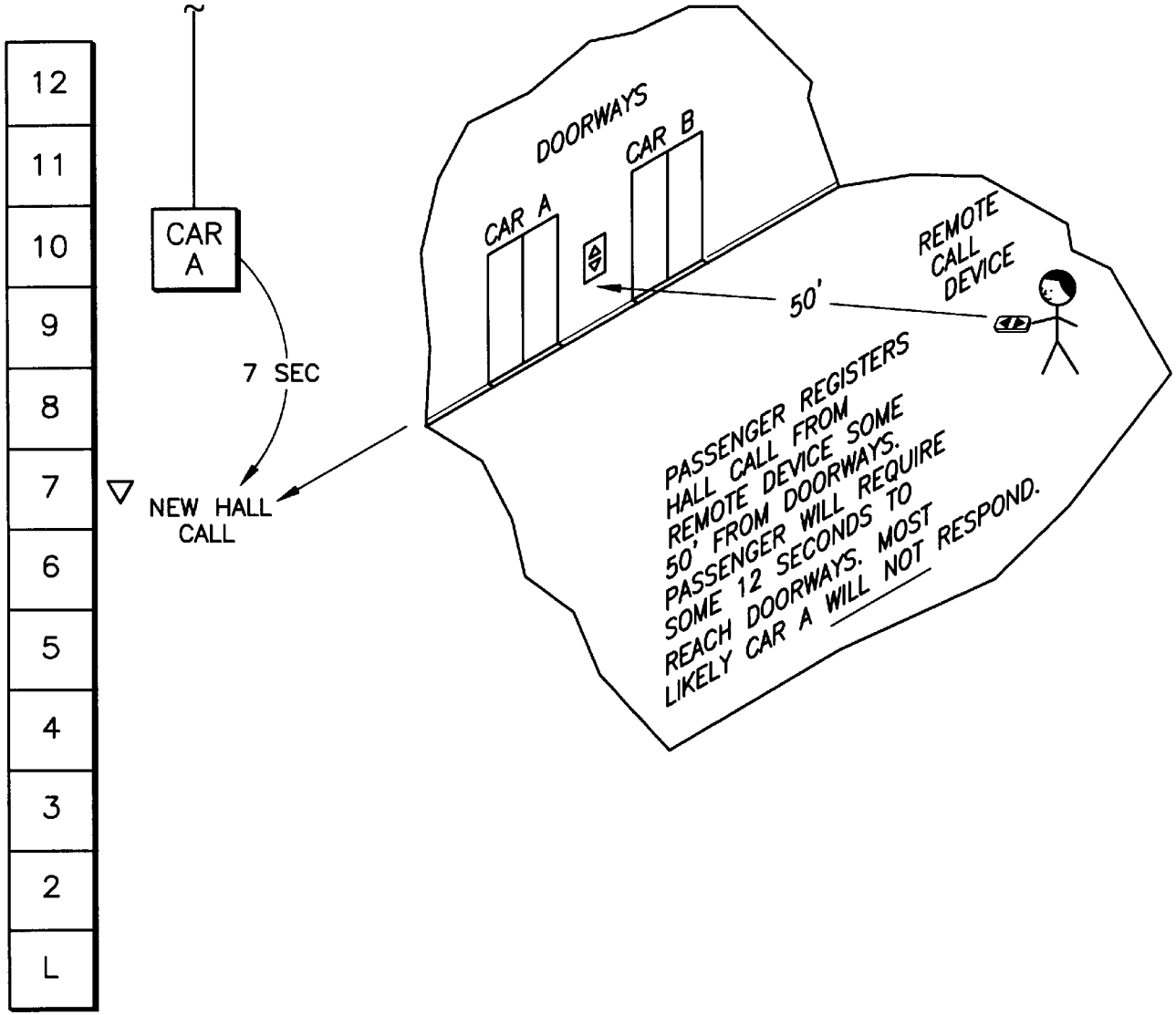
FIG. 6 shows an intending passenger registering a hall call from a remote device some distance from the hall doorways.

FIGS. 5 and 6 illustrate a change in the dispatcher logic if such a remote input source is used. FIG. 5 shows a passenger registering a new down hall call on floor 7 with the traditional hall button located near the doorways of the elevator car doors. The RRT for car A is 7 seconds, and since the passenger is known to be waiting near the car, the elevator dispatcher would, in the absence of countervailing factors, most likely select car A to respond. In FIG. 6, on the other hand, the hall button is located at a remote location, some 50 feet away. This distance requires the passenger to walk some 12 seconds or so to reach the elevators. Since the RRT of seven seconds is shorter than the walking time, the dispatcher very well might not select car A. If car A were selected, then the car would have to wait . . . perhaps with impatient passengers . . . for five seconds for the passenger to reach the car. On the other hand, if there are no passengers in the car and there are no other significant factors weighing against such a stop, the car can be assigned to stop and wait five seconds for the passenger walking toward the car. As will be evident to those of skill in the art, the particular manner of taking this walking time into account in both a qualitative and quantitative way will vary with the particular dispatching algorithm used.

In general, the remaining response time (RRT) for an elevator car can be expressed by the following equation:

$$RRT=Nf*Tf+Ns*Ts+(Ns+1)*Td$$

where:

Nf is the number of floors between car and an unassigned hall call;

Ns is the number of stops between car and the unassigned hall call, a stop for each registered car call or each registered hall call;

Tf is the time for the car to pass a floor;

Ts is the time spent at each stop; and

Td is the delay time for starting the car per stop.

In FIG. 1 and FIG. 2, it is assumed that Tf=1 sec, Ts=10 sec and Td=4 sec.

Thus, although the invention has been shown and described with respect to a best mode embodiment thereof, it should be understood by those skilled in the art that the foregoing and various other changes, omissions and additions in the form and detail thereof may be made therein without departing from the spirit and scope of the invention.

We claim:

1. Method for estimating a remaining response time (RRT) for an elevator car from among a plurality of candidate cars to serve an unassigned hall call registered by an intending passenger, comprising the steps of:

obtaining state information for said car relating to location, motion and direction;

obtaining all registered car calls assigned to said car for serving already boarded passengers;

obtaining all registered hall calls already assigned to said car for serving preboarded passengers;

obtaining destination information of said preboarded passengers and of said intending passenger; and computing said RRT based on said state information, said registered car calls, said registered hall calls, and said destination information, wherein said RRT is computed in accordance with the following equation:

$$RRT=Nf*Tf+Ns*Ts+(Ns+1)*Td,$$

with

Nf being the number of floors between said car and the unassigned hall call;

Ns being the number of stops between said car and the unassigned hall call, a stop for each registered car call or each registered hall call;

Tf being the time for said car to pass each of said floors;

Ts being the time spent at each of said stops; and

Td being the delay time for starting car per stop.

2. The method of claim 1, wherein said destination information of said intending passenger includes a time lag corresponding to said intending passenger traversing a distance beginning at a time of registering said unassigned hall call to a time of meeting said elevator car.

3. Apparatus, for estimating a remaining response time (RRT) for an elevator car from among a plurality of candidate cars to serve an unassigned hall call registered by an intending passenger, comprising:

means for obtaining state information for said car relating to location, motion and direction;

means for obtaining all registered car calls assigned to said car for serving already boarded passengers;

means for obtaining all registered hall calls already assigned to said car for serving preboarded passengers;

means for obtaining destination information of said preboarded passengers and of said intending passenger; and means for computing said RRT based on said state information, said registered car calls, said registered hall calls, and said destination information, wherein said RRT is computed in accordance with the following equation:

$$RRT=Nf*Tf+Ns*Ts+(Ns+1)*Td,$$

with

Nf being the number of floors between said car and the unassigned hall call;

Ns being the number of stops between said car and the unassigned hall call, a stop for each registered car call or each registered hall call;

Tf being the time for said car to pass each of said floors;

Ts being the time spent at each of said stops; and

Td being the delay time for starting car per stop.

4. The apparatus of claim 3, wherein said destination information of said intending passenger includes a time lag corresponding to said intending passenger traversing a distance beginning at a time of registering said unassigned hall call to a time of meeting said elevator car.

* * * * *